US006089420A

United States Patent [19]

Rodriguez

[11] Patent Number: 6,089,420

[45] Date of Patent: Jul. 18, 2000

[54] MOBILE POTABLE WATER VENDING APPARATUS

[76] Inventor: Roman D. Rodriguez, 172 Southwind Dr., El Centro, Calif. 92243

[21] Appl. No.: 09/220,095

[22] Filed: Dec. 23, 1998

Related U.S. Application Data

[63] Continuation-in-part of application No. 08/953,740, Oct. 17, 1997, abandoned.

[51] Int. Cl.[7] ..... B65B 1/04

[52] U.S. Cl. ..... 222/608; 141/231; 141/18; 141/98

[58] Field of Search ..... 141/231, 1, 2, 141/18, 98, 286; 222/608

[56] References Cited

U.S. PATENT DOCUMENTS

| | | | |
|---|---|---|---|
| 4,165,040 | 8/1979 | Beacham et al. . | |
| 4,354,364 | 10/1982 | Holder et al. . | |
| 4,359,073 | 11/1982 | de Stoutz . | |
| 5,358,009 | 10/1994 | Cambell | 137/899 |
| 5,507,329 | 4/1996 | Shub . | |
| 5,803,139 | 9/1998 | Kennedy | 141/231 |

OTHER PUBLICATIONS

Campbell; Pre–treatment and Delivery of Ozonoted Artesian Water; Sep. 1998 issue, *Water Conditioning & Purification*, p. 116 et sea.

*Primary Examiner*—Steven O. Douglas
*Attorney, Agent, or Firm*—C. Michael Zimmerman

[57] ABSTRACT

A mobile vending apparatus for potable water is described. A flat bed truck has both one or more tanks for a large supply of potable water and one or more delivery cabinets for dispensing such water into bottles or other containers provided by consumers.

8 Claims, 2 Drawing Sheets

MOBILE POTABLE WATER VENDING APPARATUS

CROSS-REFERENCE TO RELATED APPLICATION

This patent application is a continuation-in-part of my earlier patent application Ser. No. 08/953,740 filed Oct. 17, 1997, now abandoned, entitled POTABLE WATER HOME-DELIVERY SYSTEM.

DISCLOSURE

BACKGROUND OF THE INVENTION

The present invention relates to the delivery of potable water and, more particularly, to a mobile potable water vending apparatus.

Bottled water is commonly used for drinking purposes. In this connection, many homes now include a dispenser or other apparatus for bottled water. The consumer generally is required to have bottled water delivered to him/her in bottles of certain designated sizes. Some locations also include vending apparatus in which a consumer can take an empty container to be filled.

SUMMARY OF THE INVENTION

The present invention relates to a mobile potable water vending apparatus. It comprises a land vehicle, such as a truck, which carries one or more tanks of potable water and one or more dispensers for use for consumers. The consumer can then have a water bottle or the like filled right at his/her residence. Besides giving a consumer a choice as to the size of the container to be filled and whether or not it is to be filled to capacity, there are certain consumers, such as the disabled and elderly, who otherwise would not be able to have bottled water.

The water vending truck of the invention is similar to an ice cream truck in that in many situations it is only necessary to announce its arrival within a neighborhood to attract consumer business. As will be described in more detail hereinafter, the truck carries one or more dispensing stations for filling consumers' bottles or other containers in an isolated environment.

The invention is to be contrasted with other arrangements provided in the past for delivering potable water in bulk form to a large, immovable container that a customer might have. Other features and advantages of the invention either will become apparent or will be described in connection with the following, more detailed description of a preferred embodiment of the invention and variations.

BRIEF DESCRIPTION OF THE DRAWING

With reference to the accompanying drawing.

DETAILED DESCRIPTION OF THE PREFERRED EMBODIMENTS

The following, relatively detailed description is provided to satisfy the patent statutes. It will be appreciated by those skilled in the art, though, that various changes and modifications can be made without departing from the invention.

Figure 1:
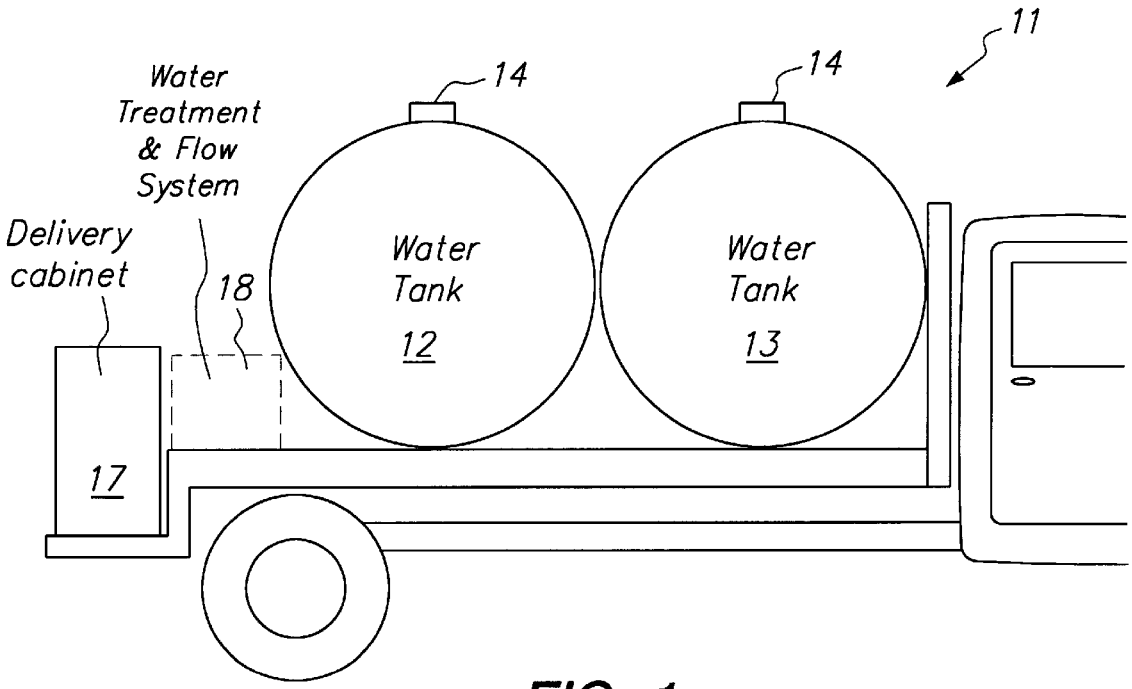
FIG. 1 is a partial side elevational and schematic view of a preferred embodiment of the invention.

A land vehicle in the form of a flat bed truck is denoted in FIG. 1 by the reference numeral 11. A pair of water supply tanks 12 and 13 are mounted on the bed of such truck. The purpose of tanks 12 and 13 is to carry a potable water supply and, in this connection, each includes a filling location schematically illustrated with a cap 14. In one implementation of the invention, tanks 12 and 13 were each 500 gallon tanks with the result that the truck was capable of carrying a supply of 1,000 gallons of potable water.

In keeping with the invention, the truck 11 also includes one or more (in this case, two) dispensing stations in the form of delivery cabinets 16 (FIG. 2) and 17. A water treatment and flow system 18 is provided for delivering water from the tanks to the dispensing stations, which system will be described in more detail hereinafter. It includes flow control valves 19 and 21 respectively associated with dispensing stations 16 and 17 for controlling flow of water from the tanks to the dispensing station outlets.

Figure 2:
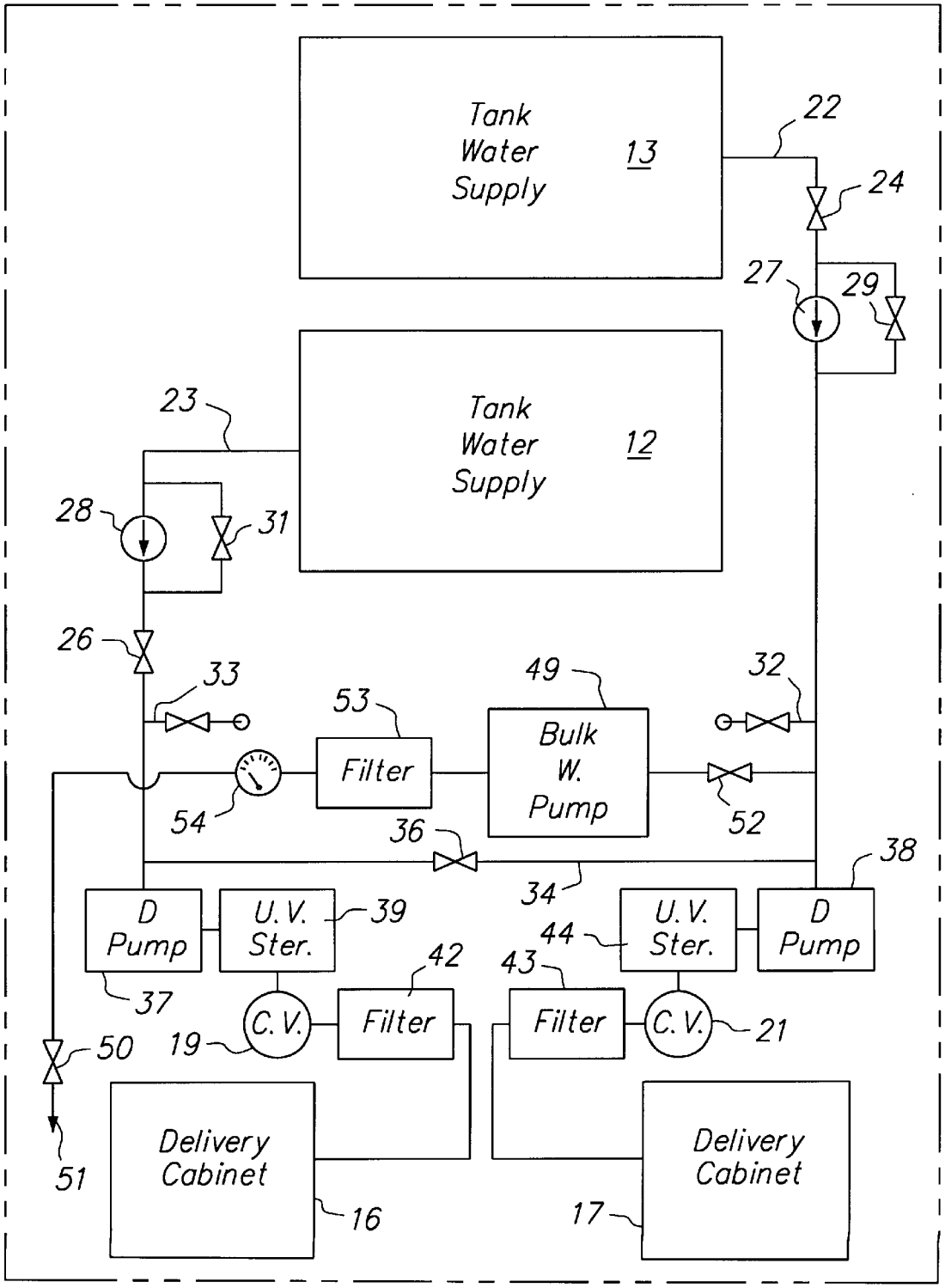
FIG. 2 is a schematic diagram of the major aspects of the preferred embodiment.

FIG. 2 illustrates in schematic form the full water system. It includes, of course, the pair of water supply tanks 12 and 13 as well as the delivery cabinets 16 and 17. Each tank has an outlet adjacent its bottom at 22 and 23 and each includes at its outlet at emergency shut-off ball valve represented at 24 and 26. In one implementation, the line for the outlets and all the requisite water flow lines were provided by PVC tubing. Check valves 27 and 28 are also associated with each tank to assure that water only flows from the tank and not into the same. By-pass valves 29 and 31 are provided to enable the respective check valves 27 and 28 to be by-passed if needed. Each tank output line also has a valve controlled drain line 32 and 33. In one implementation, the outlets from the drain valves simply pass through the floor of the carrying flat bed truck so that, if necessary, a tank could be drained.

The outlets from the two tanks are connected together as represented by the line 34. Communication between such outlets and, hence, between the tanks, is controllable via a ball valve or the like 36 in the line 34.

The tank outlet lines 22 and 23 are connected respectively to demand pumps 37 and 38 associated with the delivery cabinets 16 and 17. These demand pumps provide water on demand from the water supply whenever it is required in the associated delivery cabinet as determined by the setting of the associated control valves 19 and 21. Water pumped by the demand pump is directed to the associated control valve through a ultraviolet light sterilization unit, such as one of the UV 20 series available from Pura, Inc. of Valencia, Calif. The sterilization units associated respectively with demand pump 37 and demand pump 38 are indicated by blocks 39 and 41. Safety switches preferably are provided to assure that the demand pumps and associated UV sterilization units are not turned "on" at inappropriate times.

After passing through one of the control valves, water on its way to the associated dispensing station passes through a filter 42 or 43. These filters, typically sediment filters, are provided to remove particulate matter in the water of greater than 5 micron size. Although the water provided to the tanks is classified as water suitable for bottling, it is desirable to have a particulate filter at the very end of the delivery system to remove those fine particles produced by operation of the valves.

Figure 3:
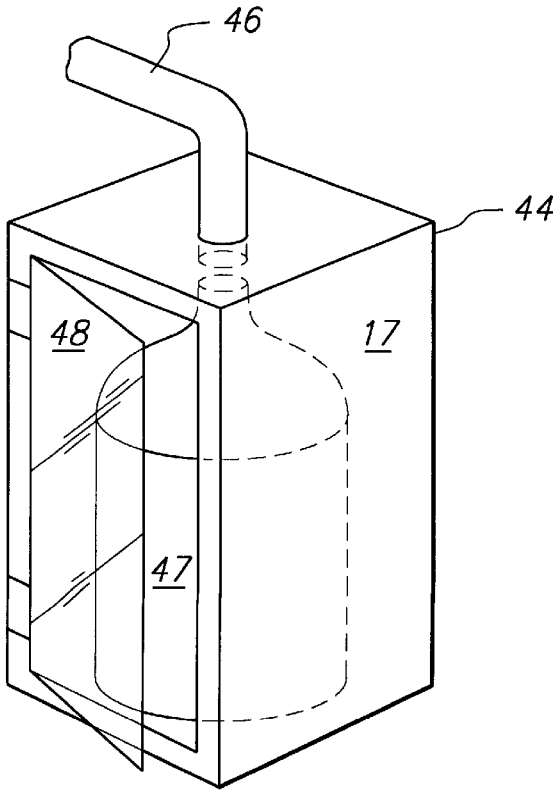
FIG. 3 is an enlarged isometric view of a water dispensing station of the preferred embodiment.

The delivery cabinet of a dispensing station on the truck in keeping with the invention is illustrated in somewhat more detail in FIG. 3. It basically is simply a stainless steel box 44 having a water pipe outlet 46 extending centrally through its top into its interior. When a container as shown in FIG. 3 at 47 is to be filled, it is placed within the cabinet with its mouth in registration with the water outlet provided by pipe 46. The cabinet preferably is provided with a water drain 4 (not shown). The door 48 for the cabinet is then closed to isolate the container from the ambient atmosphere during the filling operation. (In one implementation of the invention, the door 48 was spring loaded so that it would automatically close to provide such isolation.) It is to be noted that the door is transparent so that the operator can visually monitor the filling operation.

In some instances, primarily in emergencies, it is necessary that bulk water be supplied from the tanks 12 and 13. For this purpose, a bulk water pump 49 is provided which furnishes water through a ball valve 50 to a nozzle 51.

The bulk water pump 49 typically is a high-capacity pump (in one implementation, a pump was used which pumped nine gallons per minute). A valve 52 is provided at the inlet of such pump to protect it from the water pressure of the system and to control leaking through such pump. In this connection, such valve is normally closed. Operation of the bulk water pump is controlled by a on-off switch (not shown) which directs current at the appropriate voltage to such pump.

Water furnished by the bulk pump is passed through both a filter 53 (which filter if provider to provide appropiate taste, color and odor to water and a meter 54. The purpose of the meter is to measure the amount of water that is so delivered.

As mentioned at the beginning of the detailed description, applicant is not limited to the specific embodiment and variations described above. They are exemplary, rather than exhaustive. For example, from the broad standpoint, the number of water tanks and dispensing stations is variable. The claims, their equivalents and their equivalent language define the scope of protection.

What is claimed is:

1. A mobile potable water vending apparatus comprising a land vehicle carrying:

A. a water supply container;

B. a potable water dispensing station including a cabinet for enclosing a water container bottle to be filled with water;

C. delivery means for delivering water from said supply container to said dispensing station; and D. a flow control valve associated with said dispensing station for controlling flow of water from said supply container to said dispensing station.

2. The mobile potable water vending apparatus of claim 1 wherein said delivery means includes an ultraviolet light water treatment apparatus positioned to apply ultraviolet light to water being delivered from said water supply container to said dispensing station.

3. The mobile potable water vending apparatus of claim 1 wherein said delivery means further includes a demand pump for pumping water from said supply container to said dispensing station whenever said control valve is in a flow-on position.

4. The mobile potable water vending apparatus of claim 1 wherein said water supply container is furnished with potable water.

5. The mobile potable water vending apparatus of claim 1 wherein said delivery means includes a filter through which water is passed in traveling between said supply container and said dispensing station, which filter removes particulate matter from said water.

6. The mobile potable water vending apparatus of claim 1 wherein said cabinet includes a door enabling a water bottle to be placed within the same, which door is closeable to define with the remainder of said cabinet, an enclosure for separating a bottle while being filled from the ambient atmosphere.

7. The mobile potable water vending apparatus of claim 6 wherein said door is transparent to enable an operator to visually monitor the filling operation.

8. The mobile potable water vending apparatus of claim 1 further including on said land vehicle a supply hose for delivering water directly from said water supply container.

* * * * *